United States Patent [19]

Clement

[11] 4,042,222

[45] Aug. 16, 1977

[54] MIXER

[76] Inventor: Andrew B. Clement, 1623 Stonecliff Drive, Decatur, Ga. 30033

[21] Appl. No.: 719,971

[22] Filed: Sept. 2, 1976

Related U.S. Application Data

[63] Continuation-in-part of Ser. No. 616,371, Sept. 24, 1975.

[51] Int. Cl.[2] ..... B28C 5/20

[52] U.S. Cl. ..... 259/176

[58] Field of Search ..... 259/175, 176, 177 R, 259/174, 177 A, 3, 14, 30, 81 R, 89, 57

[56] References Cited

U.S. PATENT DOCUMENTS

| | | | |
|---|---|---|---|
| 1,056,974 | 3/1913 | Conway | 259/175 |
| 1,920,025 | 7/1933 | Thordsen | 259/176 |
| 2,981,524 | 4/1961 | Yager | 259/177 R |
| 3,084,917 | 4/1963 | Graybill | 259/177 R |
| 3,173,665 | 3/1965 | Hall | 259/177 R |

*Primary Examiner*—Robert W. Jenkins

*Attorney, Agent, or Firm*—Schuyler, Birch, Swindler, McKie & Beckett

[57] ABSTRACT

This mixer is for a manullay mixing mortar, concrete or the like in relatively small batches. A rotatable mixer barrel is supported on a wheeled frame by a bearing at its closed end and a circular guide wheel engaging grooved support wheels at its open end. The mixer barrel is rotated by means of the guide wheel. It can be dumped by manually tilting the frame.

16 Claims, 10 Drawing Figures

FIG. 1
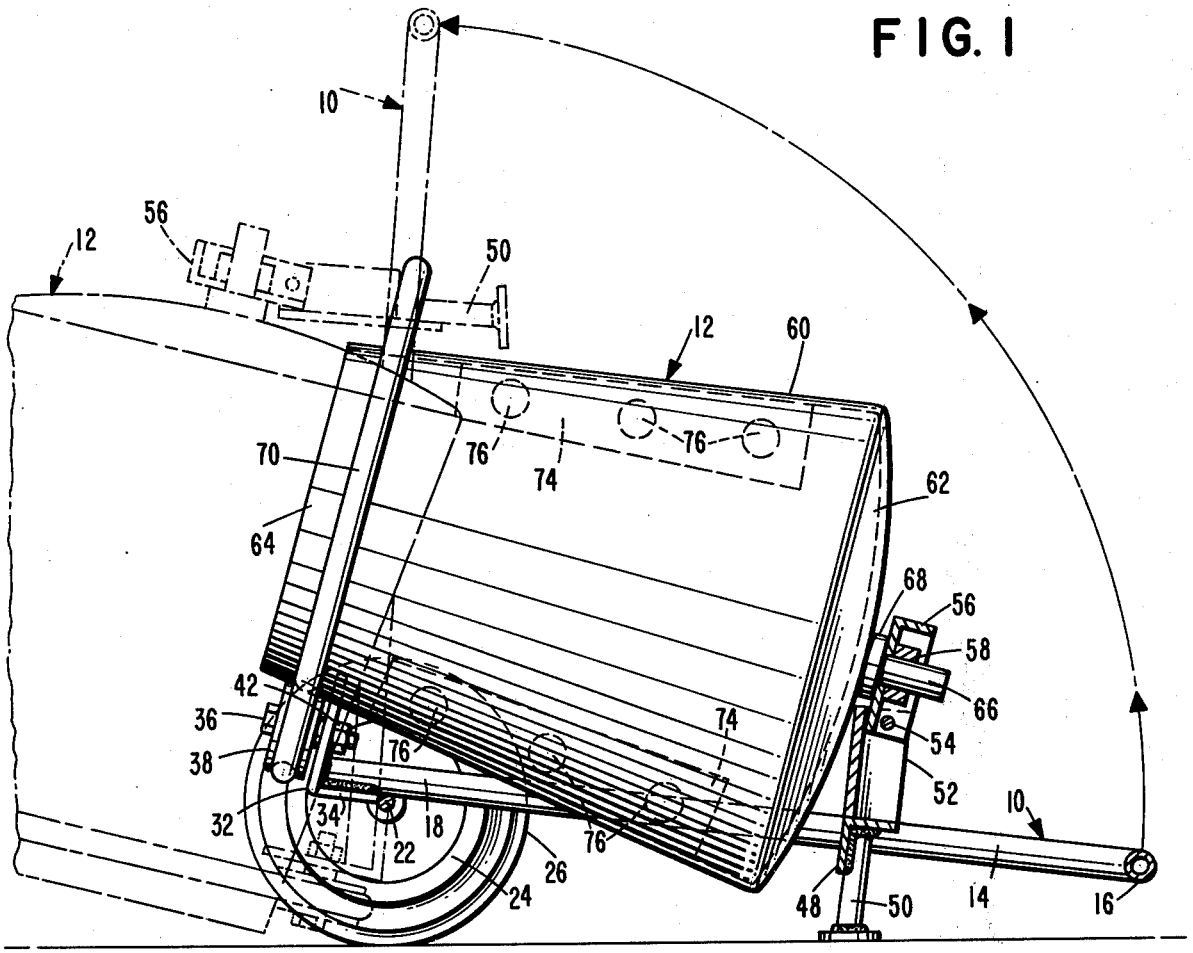
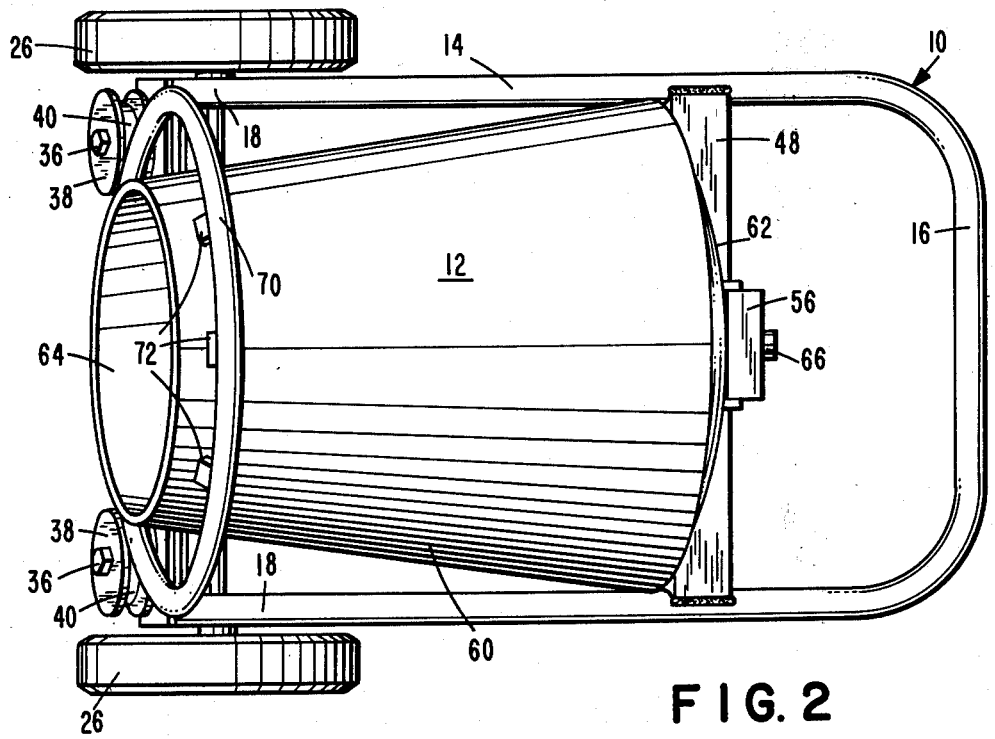
FIG. 2

FIG. 5
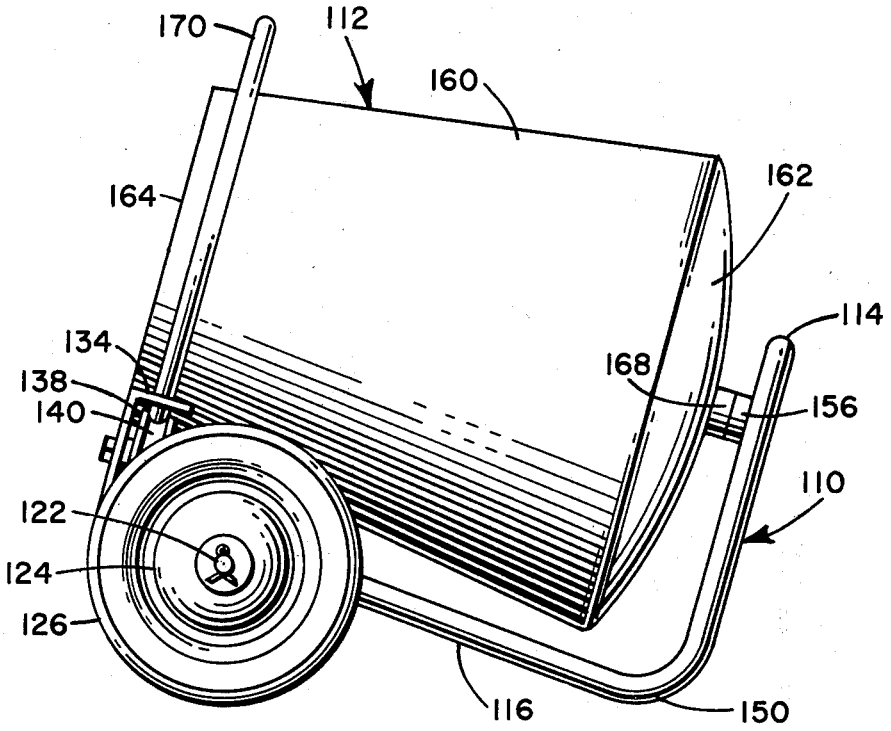
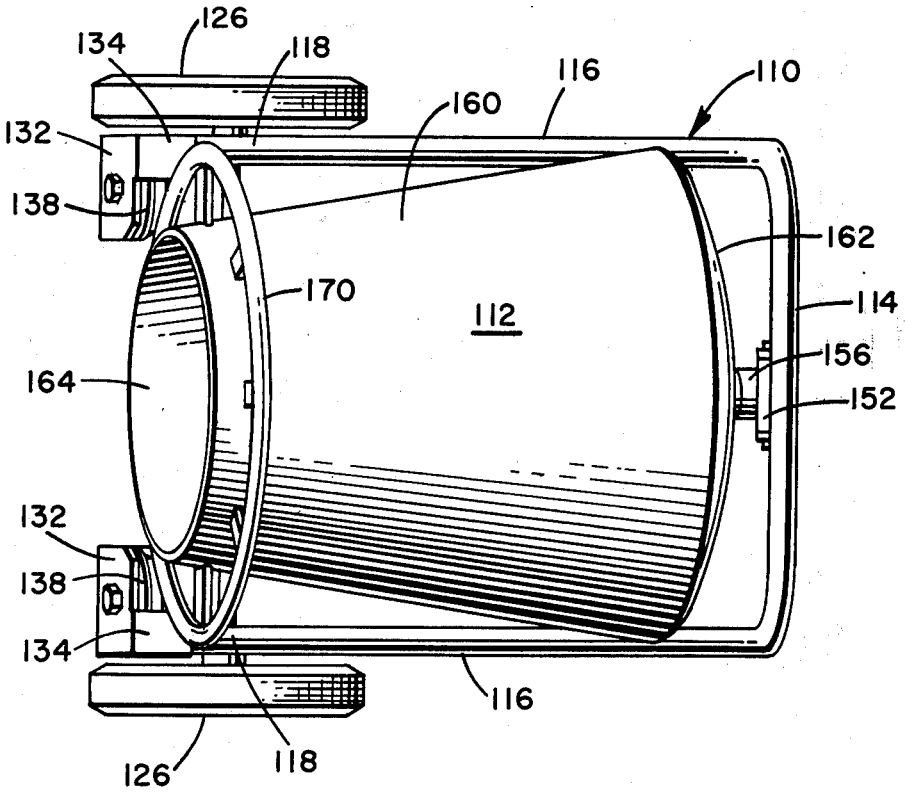
FIG. 6

FIG. 7
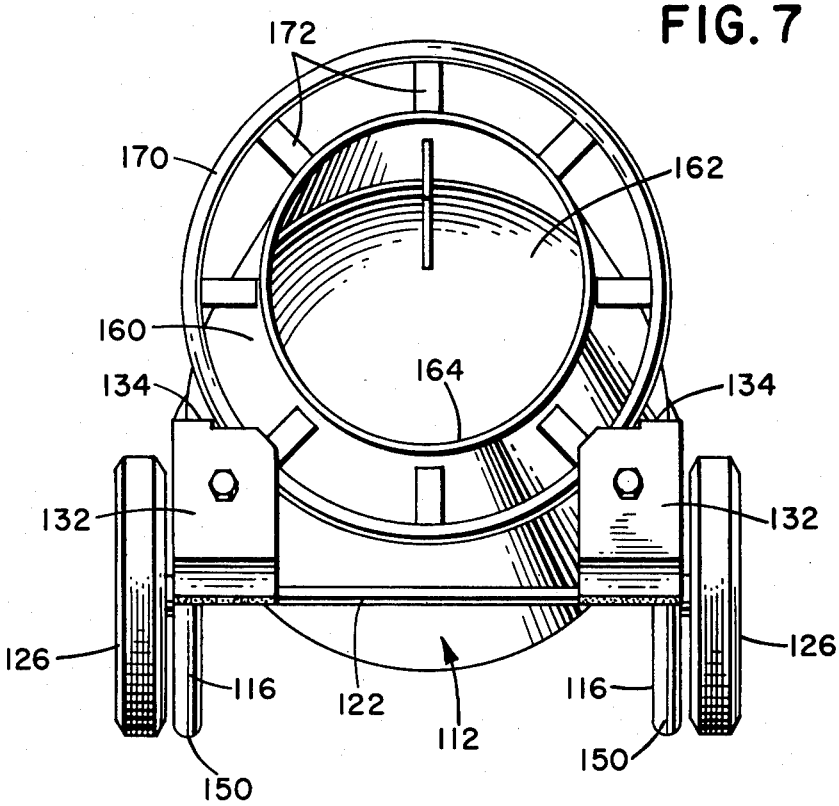
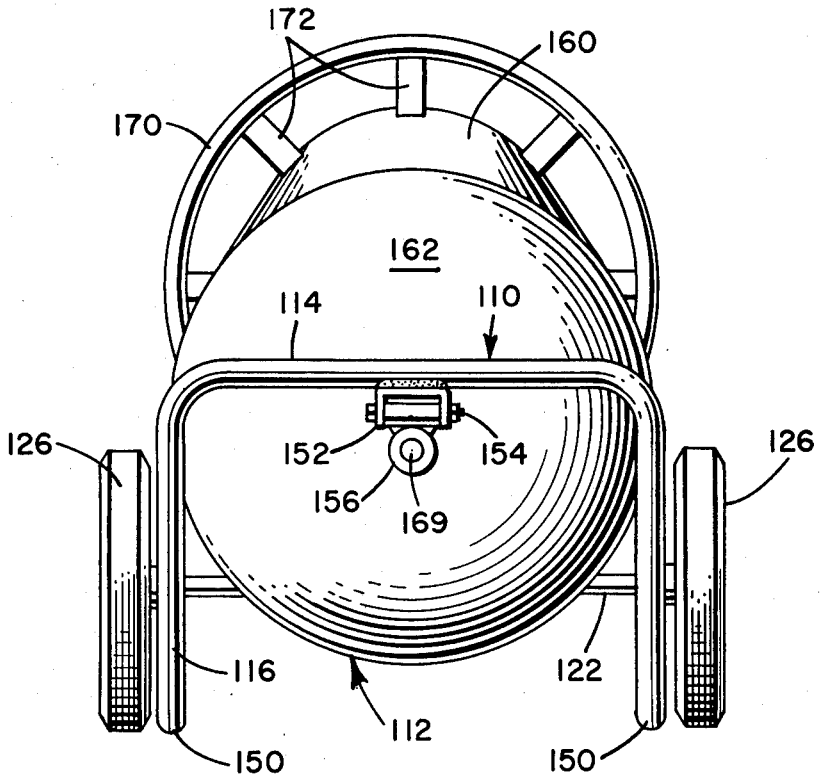
FIG. 8

MIXER

RELATED APPLICATION

This is a continuation-in-part of application Ser. No. 616,371, filed Sept. 24, 1975.

BACKGROUND OF THE INVENTION

There exists in the mixing field a requirement for relatively small, simple and effective mixers for mortar, concrete, and the like. While there are many mixers shown in the prior art, none have been designed specifically for the small, simple jobs done by homeowners or contractors, where the key factors are low cost and weight, effectiveness, and portability.

The invention set forth herein answers the need present in the field.

SUMMARY OF THE INVENTION

It is an object of this invention to provide a compact and efficient manually operated mixer.

Another object of the invention is to provide a compact mixer that can easily be assembled and disassembled.

The mixer of this invention comprises two basic components: a wheeled frame and a mixing barrel. The frame has a pair of spaced wheels at one end and a handle at the other end. Mounted on the wheeled end are a pair of spaced laterally oriented grooved wheels rotatably mounted on axles and inclined slightly to the vertical when the mixer is in its operating position. Mounted on the other end of the frame is a journal bearing.

The mixing barrel is open at one end. At the closed end, a support shaft is attached that is received in the bearing carried by the frame, to support one end of the mixing barrel. Surrounding the perimeter of the open end of the mixing barrel is a support ring, which is attached at spaced intervals to the mixing barrel. The support ring engages the grooved wheels to support the other end of the mixing barrel, and also serves as the handle to rotate the mixing barrel. On the inside of the mixing barrel are a plurality of perforated mixing blades.

The mixing barrel is installed and removed from the frame without the use of tools and without diassembly of components. The mixing barrel is easily rotated to the required mixing speed by use of the support ring, which is of such radius as to provide good mechanical advantage. To empty the mixing barrel, the handle end of the frame is lifted, rotating the entire mixer about the axis of its running wheel. The novel interaction between the support ring, the grooved wheels, and the journal bearing and shaft holds the mixing barrel in place, even when oriented to the vertical position.

BRIEF DESCRIPTION OF THE DRAWINGS

FIG. 1 is a side view, partially in section, of a first embodiment of the invention, with the mixer shown in a dumping position in broken lines.

FIG. 2 is a top plan view of the mixer of FIG. 1.

FIG. 5 is a side view of a second embodiment of the invention in the operating position.

FIG. 6 is a top view of the mixer of FIG. 5.

FIG. 7 is a front view of the mixer of FIG. 5.

FIG. 8 is a rear view of the mixer of FIG. 5.

DESCRIPTION OF THE PREFERRED EMBODIMENTS

A first embodiment of the invention is shown in FIGS. 1–4. The mixer comprises two basic components: a frame indicated generally as 10 and a mixing barrel indicated as 12.

Figure 3:
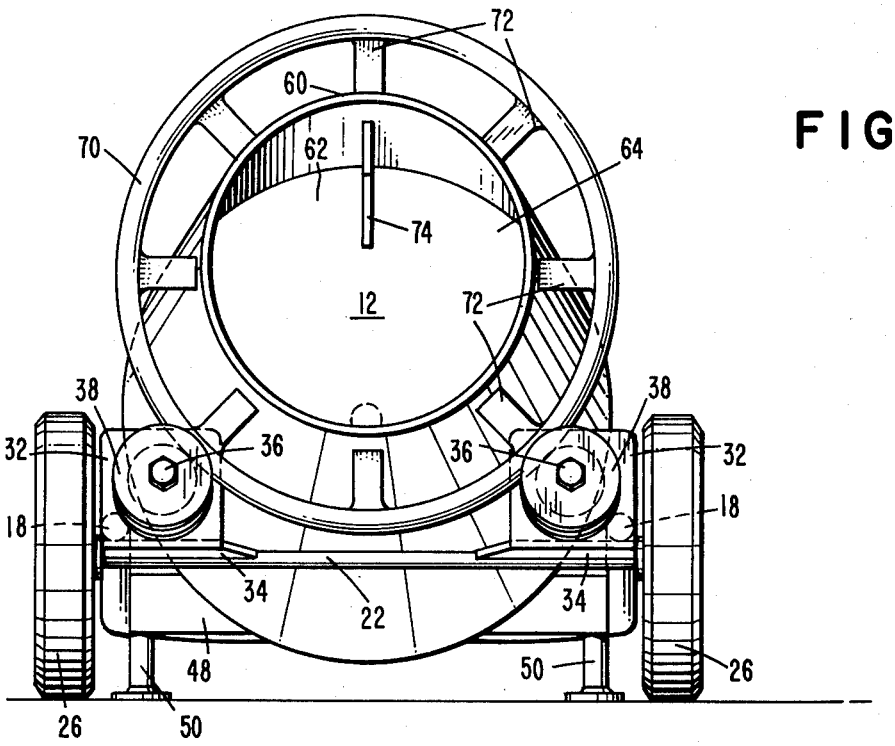
FIG. 3 is a front view of the mixer of FIG. 1.
Figure 4:
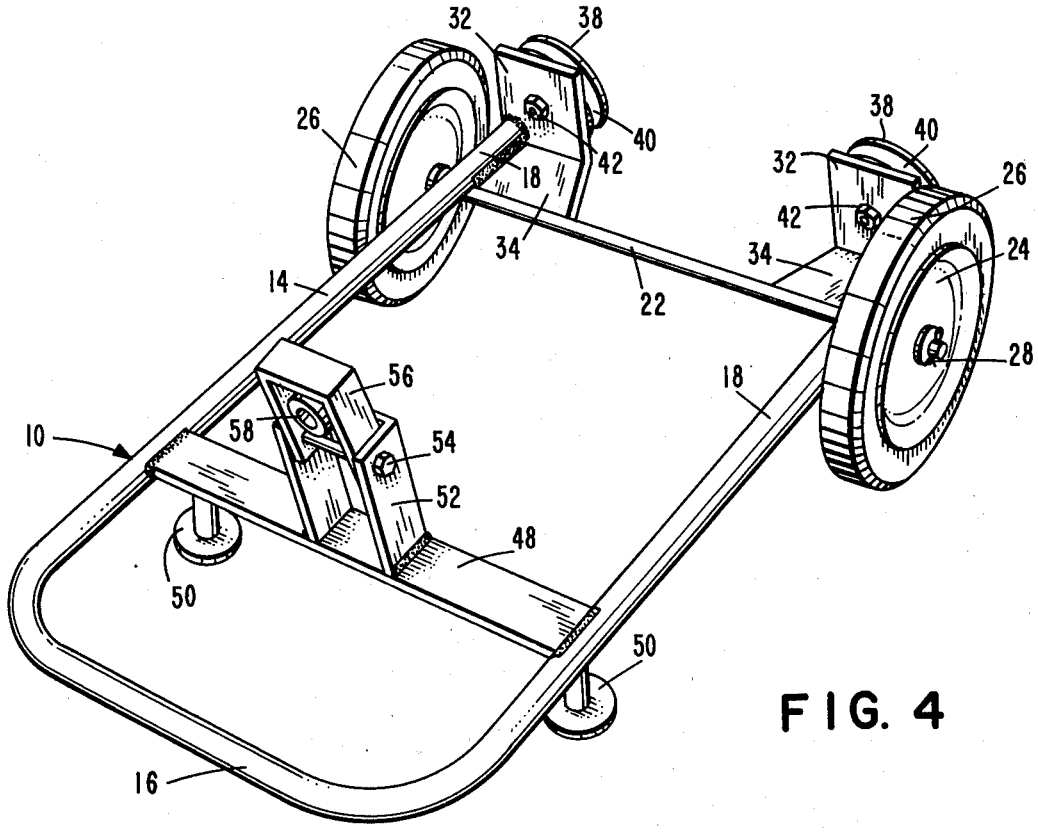
FIG. 4 is a top perspective view of the mixer of frame of FIG. 1, with the mixing barrel removed.
Figure 9:
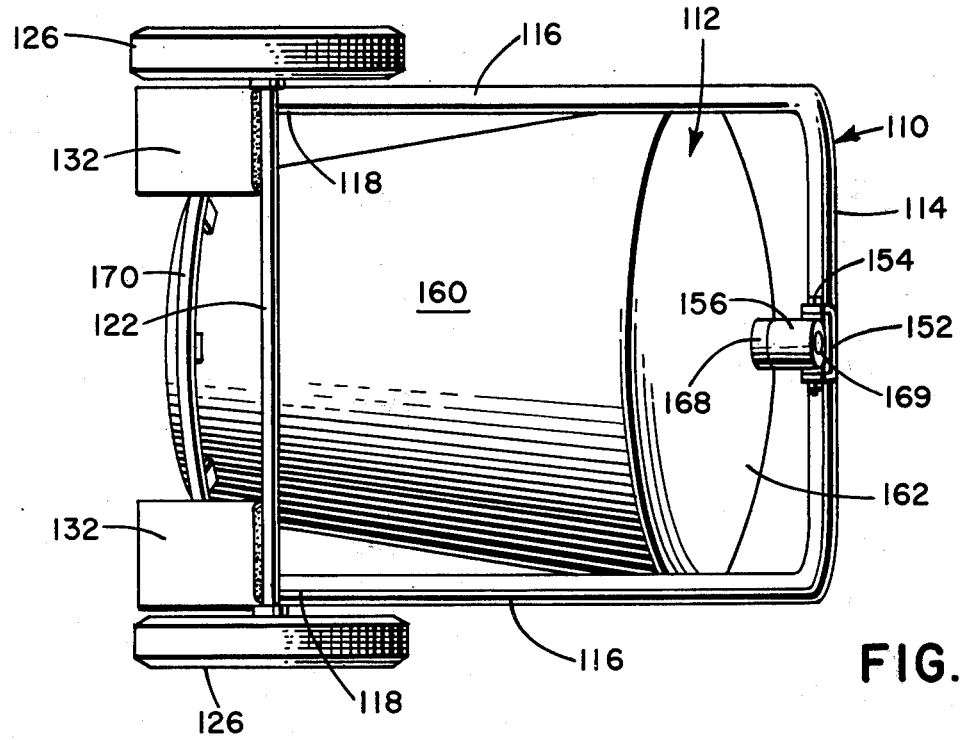
FIG. 9 is a bottom view of the mixer of FIG. 5.

The frame 10 is shown alone in FIG. 4. It consists of a U-shaped main frame member 14 which has a handle portion 16 and terminates in free ends 18. Attached near to free ends 18 is an axle 22, upon which are rotatably mounted two wheels 24 having rubber tires 26. Wheels 24 can be removably attached to axle 22 by means of cotter pins 28, or other suitable fasteners. Axle 22 is the point about which the entire loaded mixer is rotated to the dumping position, so the position of the axle axially along frame member 14 is selected to allow the mixing barrel to be spaced from the ground when being dumped.

Attached to the terminus of each of free ends 18 is a support plate 32, which is inclined slightly to a plane perpendicular to frame member 14, as shown best in FIG. 1. A brace plate 34 on each side adds strength to this portion of the structure. Each support plate 32 has an opening to receive a bolt 36, which rotatably supports a support wheel 38. An annular groove 40 extends around the periphery of each wheel 38. Bolt 36 is secured by a nut 42. Support wheels 38 are inclined to a plane perpendicular to frame member 14.

Adjacent to the handle portion 16 is a bearing support strut 48. Attached to the lower surface of strut 48 are a pair of downwardly extending feet 50. Mounted on the upper surface of support strut 48 is a channel member 52. Pivotally mounted upon channel member 52 by a bolt 54 is a bearing block 56, which supports a cylindrical journal bearing 58.

The mixing barrel 12 is a frustoconical shape, comprising a sidewall 60 and a dome-shaped base 62. Opposite base 62 is the mixer opening 64. Attached to the outside of the base 62, and located on the mixing barrel axis, is a stub shaft 66, mounted on a plate 68. In its assembled position, stub shaft 66 is received in bearing 58, as shown in FIG. 1.

Adjacent to opening 64, and encircling the entire mixing barrel, is a tubular ring 70, which is attached to the outer surface of sidewall 60 by a plurality of arms 72. Ring 70 is received by grooves 40 in wheels 38, when the mixing barrel is in the assembled position.

A plurality of mixing blades 74, each having perforations 76, are attached to the inside surface of sidewalls 10.

The relationship between the mixing barrel and certain components to the frame is important. Looking to FIG. 1, it should be noted that the axis of rotation of mixing barrel 12 is substantially parallel to the axis of rotation of wheels 38, but that both of these are at an angle to a plane through frame member 14. It should also be noted that the axis of mixing barrel 12 is preferably inclined to the horizontal when the mixer is in its mixing position, to facilitate loading to maximize the mixing capacity.

This invention is particularly well suited for making compact, light weight portable mixers for mixing relatively small batches of mortar, concrete, or the like.

Typically, they are of such size as easily to be assembled, disassembled, and moved by one man, and can be carried in the trunk of an auto or in a small truck. For example, the length of frame 10 can be about 36 inches, and its width about 20 inches. Tires 26 could be of about 10 inches in diameter. A typical mixing barrel would have a major diameter of about 18 inches and an opening of about 12 inches in diameter, with the length being about 20 inches. Grooved wheels 38 of three and one half inch diameter engage ring 70 of about eighteen inches in diameter. Of course, larger or smaller dimensions are possible, within the general concepts of the invention.

To assemble mixing barrel and frame, the frame is placed on the ground, as shown in FIG. 1, and the barrel is positioned by first inserting shaft 66 into bearing 58, and then engaging ring 70 with grooved wheels 38. Disassembly is accomplished in reverse fashion. Assembly and disassembly is made easier by the pivotally mounted bearing 58, which allows the mixing barrel shaft to be easily engaged with the bearing sleeve.

The length of legs 50 is such that, as shown in FIG. 1, the axis of mixing barrel 12 is inclined to the horizontal. The ingredients to be mixed are loaded into mixing barrel 12, and the mixing barrel is then rotated by manually turning ring 70. When mixing has been accomplished, the contents can be dumped from the mixer by lifting handle portion 16 upwardly, thus pivoting the device about axle 22 even as far as a generally vertical position, if necessary, although an angle of about sixty degrees to the horizontal has been found to be sufficient. Even when the axis of barrel 12 is near vertical, the barrel does not disengage from the frame because of the novel relationship and interaction between ring 70 and grooved wheels 38, and shaft 66 and bearing 58. At the usual dumping angles, the mixing barrel can be rotated to assist in dumping the contents, with no danger of disengagement of the mixer from the frame.

A second embodiment of the invention is shown in FIGS. 5–10. Again, the mixer consists of two basic components: a mixer frame 110 and a barrel 112.

Frame 110 comprises a single tubular element that is formed into a U-shaped handle portion 114 and a pair of integral leg or base members 116. Each base member 116 terminates in a free end 118, to which is attached an axle 122 and wheels 124 with tires 126. Attached to each free end 118 is a support plate 132, which is substantially perpendicular to base members 116. A flange 134 extends from support member 132, partially screening a support wheel 138, which is bolted to member 132. An annular groove 140 extends around each of wheels 138.

When in the operating position shown in FIG. 5, the mixer rests upon portions 150 of frame 110. A bearing block 156 is attached to handle portion 114 at the mixer centerline by means of a mounting element 152 and a bolt 154.

Mixing barrel 112 is exactly like the one described above in regard to the first embodiment of the invention. Basically, it has a sidewall 160 and a base 162. The mixer opening is designated as 164. The base 162 is provided at its center with a bearing plate 168, which supports a stub shaft (not shown) that is received in bearing block 156. Tubular ring 170 encircles opening 164, being supported on the mixer barrel by a plurality of arms 172. Ring 170 is received in grooves 140 of wheels 138, when the mixer is assembled.

Figure 10:
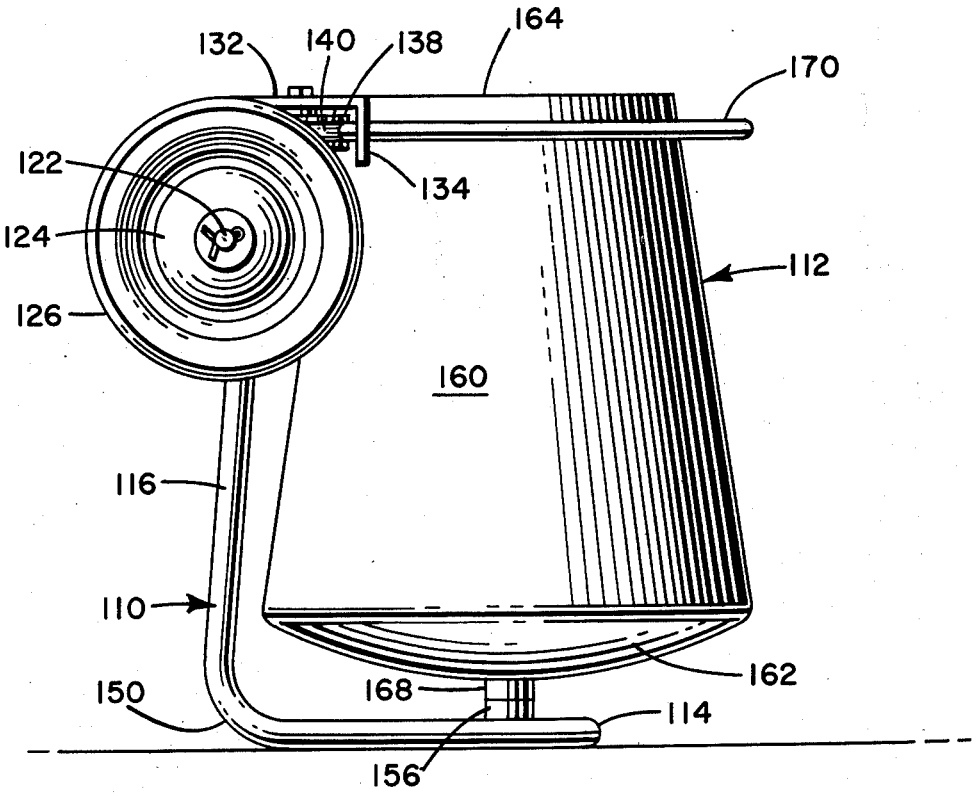
FIG. 10 is a side view of the mixer of FIG. 5 in the loading position.

Again, as with the first embodiment, the relationship between mixer barrel 112 and frame 110 is important. The details of this are exactly like those explained above with regard to the first embodiment. In the second embodiment, the mixer can be placed in the vertical position for loading, as is shown in FIG. 10, wherein it rests upon handle portion 114. After loading, it is tipped to the operating position (FIG. 5), wherein the axis of mixing barrel 112 is inclined from the horizontal. In this position, the contents of the barrel are mixed by rotating the barrel by means of handle 170. The contents can be dumped by tilting the mixer about axle 122, as necessary. The edge of opening 164 is substantially aligned with the outer periphery of tires 126 (FIG. 1), so that the opening can be oriented horizontally, flat against the ground, for example, if necessary.

Assembly and disassembly are accomplished in the same manner as with the first embodiment.

While modifications and variations from the embodiments described above may now become evident to those skilled in the art, the scope of the invention is governed only by that of the appended claims:

I claim:

1. A mixer comprising:

frame means having first and second ends and a longitudinal frame axis, a pair of frame wheels for transporting the mixer mounted at said first end of said frame means parallel to said frame axis, handle means mounted on said second end of said frame means, a pair of mixing barrel support wheels rotatably mounted on said frame means at said first end thereof, said pair of support wheels being spaced from one another laterally flanking said frame axis and being generally vertically oriented, said mixing barrel support wheels having annular grooves extending around the entire periphery thereof, bearing means mounted on said frame means along said frame axis spaced from said first end, said bearing means having a bearing opening for receiving a mixing barrel shaft, a mixing barrel of generally frustoconical shape having side walls, a base, and an opening opposite said base, a mixing barrel shaft attached to said base along a mixing barrel axis and engageable with said bearing means, a circular handle ring mounted on said mixing barrel surrounding said mixer opening, said handle ring being mounted on arm means attached to said mixing barrel and spacing said handle ring radially from said mixing barrel, the axis of said ring being coincident with the axis of said mixing barrel, said ring being engageable with said grooves in said mixing barrel support wheels and functioning to support said mixing barrel and to be grasped by the operator to rotate said mixing barrel.

2. The mixer of claim 1 wherein said mixer is pivotable by means of said handle about the axis of said frame wheels between an operating position wherein said mixing barrel axis is inclined downwardly to the horizontal from said mouth and a dump position wherein said mixing barrel axis is substantially vertically oriented and said mouth is downwardly oriented.

3. The mixer of claim 2 wherein the axes of rotation of said mixing barrel support wheels are parallel to said mixing barrel axis.

4. The mixer of claim 2 wherein said handle means is of generally U-shaped configuration and oriented generally perpendicular to said mixing barrel axis, and said frame means comprises a pair of base members attached to said handle means generally perpendicularly thereto, whereby said mixer can be tilted to a load position resting upon said handle means with said mixing barrel axis generally vertically oriented.

5. The mixer of claim 4 wherein said bearing means is attached to said handle means.

6. The mixer of claim 4 wherein said U-shaped handle means is joined to said base members by a curved portion to facilitate tilting of said mixer to a load position.

7. The mixer of claim 4 wherein the peripheries of said frame wheels are substantially in alignment with a plane across said mouth.

8. The mixer of claim 4 wherein the peripheries of said mixing barrel support wheels are at least partially shielded by shield means.

9. The mixer of claim 8 wherein each of said mixing barrel support wheels is mounted on a support plate attached to the end of one of said base members, and wherein said shield means comprises a flange attached to said plate and extending above said mixing barrel support wheel.

10. The mixer of claim 1 wherein said bearing means is pivotally mounted upon said frame, the pivot axis of said bearing means being perpendicular to the axis of said mixing barrel.

11. The mixer of claim 1 wherein said bearing means comprises a bearing sleeve and said shaft closely fits within said sleeve.

12. The mixer of claim 1 wherein the diameter of said circular ring is substantially the same as the major diameter of said mixing barrel.

13. The mixer of claim 1 further comprising at least one support foot extending downwardly from said frame means intermediate said first and second ends.

14. The mixer of claim 1 further comprising a plurality of mixing blades attached to the inside of said mixing barrel.

15. The mixer of claim 1 wherein said annular grooves of said mixing barrel support wheels are of such depth as to prevent appreciable lateral movement of said circular ring with respect thereto.

16. A mixer comprising:

frame means having first and second frame ends and a longitudinal frame axis, support means mounted at said first frame end, handle means mounted on said second frame end, a pair of mixing barrel support wheels rotatably mounted on said frame means at said first frame end, said pair of support wheels being spaced from one another laterally flanking said frame axis and being generally vertically oriented, said mixing barrel support wheels having annular grooves extending around the entire periphery thereof, bearing means mounted on said frame means along said frame axis spaced from said first frame end, said bearing means having a bearing opening for receiving a mixing barrel shaft, a mixing barrel having side walls, first and second mixer ends, an opening, and a mixing barrel shaft attached to one end along a mixing barrel axis and engageable with said bearing means, a circular handle ring mounted on said mixing barrel, said handle ring being mounted on arm means attached to said mixing barrel and spacing said handle ring radially from said mixing barrel, the axis of said ring being coincident with the axis of said mixing barrel, said ring being engageable with said grooves in said mixing barrel support wheels and functioning to support said mixing barrel and to be grasped by the operator to rotate said mixing barrel.

* * * * *